US008405675B2

(12) United States Patent
Peng et al.

(10) Patent No.: US 8,405,675 B2
(45) Date of Patent: Mar. 26, 2013

(54) DEVICE AND METHOD FOR CONVERTING THREE COLOR VALUES TO FOUR COLOR VALUES

(75) Inventors: Jia-Ling Peng, Taoyuan County (TW); Wen-Chih Tai, Taoyuan County (TW); Shian-Jun Chiou, Taipei (TW); Chia-Lin Liu, Taichung County (TW); Chi-Neng Mo, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 857 days.

(21) Appl. No.: 12/563,160

(22) Filed: Sep. 20, 2009

(65) Prior Publication Data

US 2011/0018891 A1 Jan. 27, 2011

(30) Foreign Application Priority Data

Jul. 22, 2009 (TW) ..... 98124741 A

(51) Int. Cl.
*G09G 5/02* (2006.01)

(52) U.S. Cl. ..... 345/604; 345/88

(58) Field of Classification Search ..... 345/604, 345/600, 589, 88; 382/167
See application file for complete search history.

(56) References Cited

U.S. PATENT DOCUMENTS 4,701,790 A * 10/1987 Yamada ..... 358/515
5,504,821 A * 4/1996 Kanamori et al. ..... 382/167
5,541,648 A * 7/1996 Udagawa et al. ..... 348/222.1
5,737,017 A * 4/1998 Udagawa et al. ..... 348/280
5,798,767 A * 8/1998 Poole et al. ..... 345/604

FOREIGN PATENT DOCUMENTS

JP 2002-318564 10/2002
JP 2006-293095 10/2006

OTHER PUBLICATIONS

"First Office Action of China Counterpart Application", issued on Feb. 24, 2011, p. 1-p. 7.

* cited by examiner

*Primary Examiner* — Ricardo L Osorio
(74) *Attorney, Agent, or Firm* — Jianq Chyun IP Office

(57) ABSTRACT

A device and a method for converting three color values to four color values are provided. In the method, a first to a third color values of a pixel are obtained. Further, a first to a third difference values between every two of the first to the third color values are respectively computed. If all of the first to the third difference values are lower than a threshold, a first to a fourth color converting values are generated according to the first to the third color values, and the fourth color converting value is higher than zero. On the contrary, the fourth color converting value is zero, and the first to the third color converting values are equal to the first to the third color values, respectively. Thereby, a color break-up can be suppressed, and color saturation can be maintained.

20 Claims, 3 Drawing Sheets

| | | |
|---|---|---|
| P1 R,G,B (10,15,8) | P2 R,G,B (120,130,75) | P3 R,G,B (110,90,120) |
| P4 R,G,B (20,28,19) | P5 R,G,B (40,35,43) | P6 R,G,B (80,50,70) |
| P7 R,G,B (40,42,33) | P8 R,G,B (130,122,128) | P9 R,G,B (50,66,70) |

| | | |
|---|---|---|
| P1 R,G,B,W (2,7,0,8) | P2 R,G,B,W (120,130,75,0) | P3 R,G,B,W (110,90,120,0) |
| P4 R,G,B,W (1,9,0,19) | P5 R,G,B,W (5,0,8,35) | P6 R,G,B,W (80,50,70,0) |
| P7 R,G,B,W (7,9,0,33) | P8 R,G,B,W (8,0,6,122) | P9 R,G,B,W (50,66,70,0) |

DEVICE AND METHOD FOR CONVERTING THREE COLOR VALUES TO FOUR COLOR VALUES

CROSS-REFERENCE TO RELATED APPLICATION

This application claims the priority benefit of Taiwan application serial no. 98124741, filed on Jul. 22, 2009. The entirety of the above-mentioned patent application is hereby incorporated by reference herein and made a part of specification.

BACKGROUND OF THE INVENTION

1. Field of the Invention

The present invention relates to a color value converting technique of a color sequential display. More particularly, the present invention relates to a technique for converting three color values to four color values.

2. Description of Related Art

In a conventional liquid crystal display (LCD), a light source of backlight module is generally designed to be a white light source, for example, a cold cathode tube. Such white light source can provide a backlight source for each pixel through color filters. Regarding a pixel array, a red (R) color filter, a green (G) color filter and a blue (B) color filter are disposed at each pixel position, which may lead to a high cost. Moreover, since the color filters are applied to the LCD, the white light source can be blocked by the color filters, so that a luminance of the LCD is decreased.

Accordingly, a color sequential display applying a color sequentially method and a control circuit is developed according to the conventional techniques. The color sequential display uses light-emitting diodes (LEDs) with various colors to replace the conventional white backlight source, in which the light sources of different colors are alternately lighted on timing to display the colors of the pixels. The conventional LCD uses the color filters to mix colors on a spatial axis, while the color sequential display mixes colors on a time axis through different color light sources, and a principle thereof is that within a time range of a visual staying principle, the R, G and B colors are swiftly switched on the time axis to achieve the color mixing effect.

The color sequential display does not require the color filters, so that the light source is not blocked, and therefore image luminance is increased. Moreover, since the color sequential display applies the LEDs as the light sources, and in coordination with a color display technique of the color sequential method, the color sequential display may have features of lightness, slimness, shortness and smallness, so that a large spatial resolution can be obtained with a low cost. Though the color sequential display has advantages of high resolution, high luminance, high color and small size, disadvantages thereof such as a color break-up (CBU) phenomenon are also derived.

The CBU phenomenon is generated due to that different color fields of an object of an image will fall on different retina points of human eyes due to the features of random saccade and instinct of tracing moving object of human eyes. Therefore, the CBU phenomenon occurs on edges of the object. FIG. 1 is a schematic diagram illustrating a color breakup phenomenon. Referring to FIG. 1, a full color image can be divided into red (R), green (G) and blue (B) sub-images. Display of the full color image can be achieved by swiftly and sequentially displaying the R, G and B sub-images. Taking a white image as an example, when the white image is required to be displayed, a left edge of the white image 100 observed from a moving observation point is a color combination of blue (B) and blue plus green (B+G), and a right edge thereof is a color combination of red (R) and red plus green (R+G), which are not the white (W) color required to be displayed.

SUMMARY OF THE INVENTION

The present invention is directed to a device and a method for converting three color values to four color values, by which a color break-up (CBU) phenomenon can be mitigated, and a color saturation can be maintained.

The present invention provides a method for converting three color values to four color values. In the method, a first color value, a second color value and a third color value of a pixel are obtained. Next, a first difference value between the first color value and the second color value, a second difference value between the second color value and the third color value and a third difference value between the third color value and the first color value are computed. If the first difference value, the second difference value and the third difference value are lower than a threshold value, a first color converting value, a second color converting value, a third color converting value and a fourth color converting value are generated according to the first color value, the second color value and the third color value, and now the fourth color converting value is greater than zero. If one of the first difference value, the second difference value and the third difference value is greater than the threshold value, the first color converting value, the second color converting value, the third color converting value and the fourth color converting value are generated, and now the fourth color converting value is zero, and the first color converting value, the second color converting value and the third color converting value are respectively equal to the first color value, the second color value and the third color value.

In an embodiment of the present invention, if the first difference value, the second difference value and the third difference value are lower than the threshold value, the first color converting value, the second color converting value, the third color converting value and the fourth color converting value are generated according to the first color value, the second color value and the third color value, and now the fourth color converting value is equal to a minimum one of the first color value, the second color value and the third color value, the first color converting value is equal to the first color value minus the fourth color converting value, the second color converting value is equal to the second color value minus the fourth color converting value, and the third color converting value is equal to the third color value minus the fourth color converting value.

In an embodiment of the present invention, the first color value, the second color value and the third color value are respectively a red color value, a green color value and a blue color value, and the first color converting value, the second color converting value, the third color converting value and the fourth color converting value are respectively the red color value, the green color value, the blue color value and a white color value. In another embodiment, the first difference value, the second difference value and the third difference value are positive integers.

The present invention provides a device for converting three color values to four color values. The device includes an input unit, a first subtraction unit, a second subtraction unit, a third subtraction unit, a determining unit and a conversion unit. The input unit obtains a first color value, a second color value and a third color value of a pixel. The first subtraction unit is coupled to the input unit and calculates a first difference value between the first color value and the second color value. The second subtraction unit is coupled to the input unit and calculates a second difference value between the second color value and the third color value. The third subtraction unit is coupled to the input unit and calculates a third difference value between the third color value and the first color value. The determining unit is coupled to the first subtraction unit, the second subtraction unit and the third subtraction unit and determines whether the first difference value, the second difference value and the third difference value are lower than a threshold value, and generates a determining result. The conversion unit is coupled to the input unit and the determining unit. If the determining result is affirmative, the conversion unit generates a first color converting value, a second color converting value, a third color converting value and a fourth color converting value according to the first color value, the second color value and the third color value, and now the fourth color converting value is greater than zero. If the determining result is negative, the conversion unit generates the first color converting value, the second color converting value, the third color converting value and the fourth color converting value, and now the fourth color converting value is zero, and the first color converting value, the second color converting value and the third color converting value are respectively equal to the first color value, the second color value and the third color value.

The present invention provides a driving method for a liquid crystal display (LCD). The LCD includes a panel module and a backlight module. The backlight module includes a red backlight source, a green backlight source, a blue backlight source and a white backlight source. The driving method can be described as follows. First, a red color value, a green color value and a blue color value of a pixel are obtained. Next, a first difference value between the red color value and the green color value, a second difference value between the green color value and the blue color value, and a third difference value between the blue color value and the red color value are computed. If the first difference value, the second difference value and the third difference value are lower than a threshold value, a red color converting value, a green color converting value, a blue color converting value and a white color converting value are generated according to the red color value, the green color value and the blue color value, and now the white color converting value is greater than zero. If one of the first difference value, the second difference value and the third difference value is greater than the threshold value, the red color converting value, the green color converting value, the blue color converting value and the white color converting value are generated, and now the white color converting value is zero, and the red color converting value, the green color converting value and the blue color converting value are respectively equal to the red color value, the green color value and the blue color value. The panel module displays a red sub image of a frame according to the red color converting value and a red backlight sent from the red backlight source. The panel module displays a green sub image of the frame according to the green color converting value and a green backlight sent from the green backlight source. The panel module displays a blue sub image of the frame according to the blue color converting value and a blue backlight sent from the blue backlight source. The panel module displays a white sub image of the frame according to the white color converting value and a white backlight sent from the white backlight source.

The present invention provides an LCD including a data processing module, a panel module and a backlight module. The data processing module includes an input unit, a first subtraction unit, a second subtraction unit, a third subtraction unit, a determining unit and a conversion unit. The input unit obtains a red color value, a green color value and a blue color value of a pixel. The first subtraction unit is coupled to the input unit and calculates a first difference value between the red color value and the green color value. The second subtraction unit is coupled to the input unit and calculates a second difference value between the green color value and the blue color value. The third subtraction unit is coupled to the input unit and calculates a third difference value between the blue color value and the red color value. The determining unit is coupled to the first subtraction unit, the second subtraction unit and the third subtraction unit and determines whether the first difference value, the second difference value and the third difference value are lower than a threshold value, and generates a determining result. The conversion unit is coupled to the input unit and the determining unit. If the determining result is affirmative, the conversion unit generates a red color converting value, a green color converting value, a blue color converting value and a white color converting value according to the red color value, the green color value and the blue color value, and now the white color converting value is greater than zero. If the determining result is negative, the conversion unit generates the red color converting value, the green color converting value, the blue color converting value and the white color converting value, and now the white color converting value is zero, and the red color converting value, the green color converting value and the blue color converting value are respectively equal to the red color value, the green color value and the blue color value. The panel module is coupled to the data processing module, and displays a red sub image of a, frame according to the red color converting value, displays a green sub image of the frame according to the green color converting value, displays a blue sub image of the frame according to the blue color converting value, and displays a white sub image of the frame according to the white color converting value. The backlight module is disposed under the panel module and includes a red backlight source, a green backlight source, a blue backlight source and a white backlight source. The red backlight source suitably generates a red backlight according to an operation of the panel module, so that the panel module displays the red sub image. The green backlight source suitably generates a green backlight according to an operation of the panel module, so that the panel module displays the green sub image. The blue backlight source suitably generates a blue backlight according to an operation of the panel module, so that the panel module displays the blue sub image. The white backlight source suitably generates a white backlight according to an operation of the panel module, so that the panel module displays the white sub image.

According to the above descriptions, in the present invention, a first to a third color values of a pixel are obtained. Further, a first to a third difference values between every two of the first to the third color values are respectively computed. If all of the first to the third difference values are lower than a threshold value, a first to a fourth color converting values are generated according to the first to the third color values, and now the fourth color converting value is greater than zero. On the contrary, the fourth color converting value is zero, and the first to the third color converting values are respectively equal to the first to the third color values. Thereby, not only a color break-up can be suppressed, but also a color saturation can be maintained.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

A conventional technique has a severe color break-up (CBU) phenomenon. Accordingly, an embodiment of the present invention provides a technique for converting three color image data into four color image data, which is adapted to a four color sequential display. First, the three color image data is received, and a first to a third difference values between every two of a red color value, a green color value and a blue color value of each pixel are respectively computed. Then, it is determined whether the first to the third difference values are lower than a threshold value. If all of the first to the third difference values are lower than the threshold value, it represents that the color of the corresponding pixel is similar to a white color, so that adjusted red color value, green color value, blue color value and white color value can be generated according to the red color value, the green color value and the blue color value, and now the white color value is greater than zero. Namely, the white color value is used to replace a color mixing effect of a part of the red color value, the green color value, and the blue color value, so as to suppress the CBU phenomenon.

On the other hand, if one of the first to the third difference values is greater than the threshold value, it represents that the color of the corresponding pixel is quite different to the white color, so that the red color value, the green color value and the blue color value are not adjusted. Namely, the adjusted red color value, the green color value and the blue color value can be respectively the same to the pre-adjusted red color value, the green color value and the blue color value, and now the white color value is equal to zero. Therefore, a color saturation is maintained. Such technique is described in detail below with reference of figures.

Figure 1:
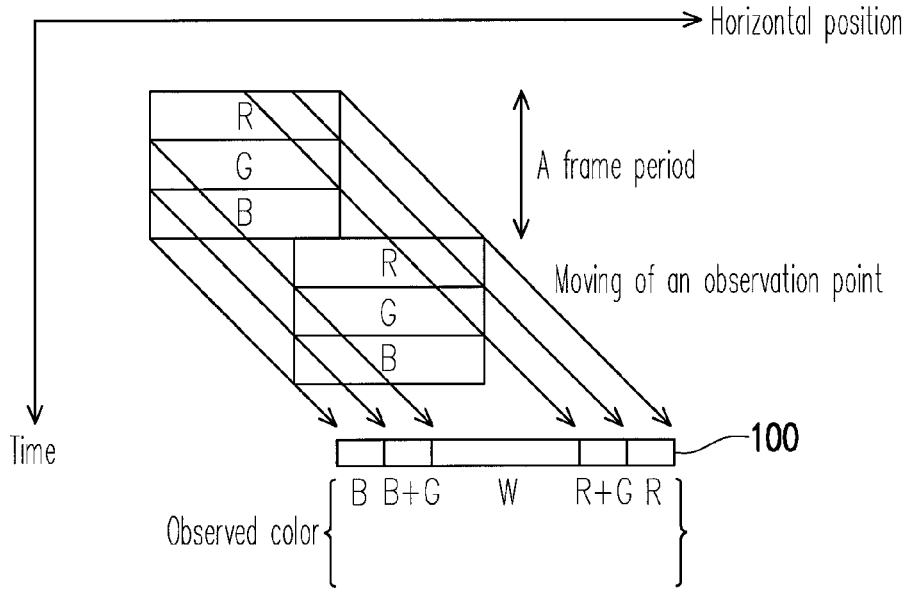
FIG. 1 is a schematic diagram illustrating a color breakup phenomenon.
Figure 2:
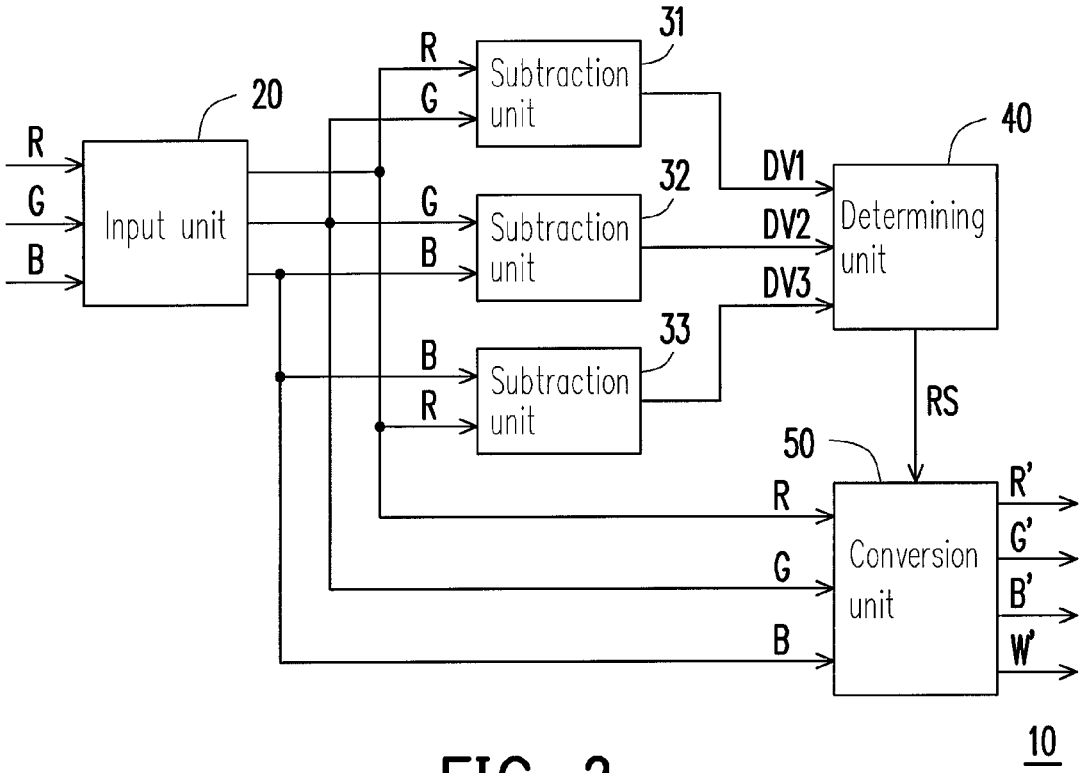
FIG. 2 is a block diagram illustrating a device for converting three color values to four color values according to an embodiment of the present invention.

FIG. 2 is a block diagram illustrating a device for converting three color values to four color values according to an embodiment of the present invention. Referring to FIG. 2, the device 10 for converting three color values to four color values includes an input unit 20, subtraction units 31-33, a determining unit 40 and a conversion unit 50. The input unit 20 is coupled to the subtraction units 31-33 and the conversion unit 50. The determining unit 40 is coupled between the subtraction units 31-33 and the conversion unit 50.

The input unit 20 receives image data composed of a plurality of pixels, wherein each pixel has a red color value R, a green color value G and a blue color value B. The subtraction unit 31 calculates a difference value between the red color value R and the green color value G, and outputs the difference value DV1 to the determining unit 40. The subtraction unit 32 calculates a difference value between the green color value G and the blue color value B, and outputs the difference value DV2 to the determining unit 40. The subtraction unit 33 calculates a difference value between the blue color value B and the red color value R, and outputs the difference value DV3 to the determining unit 40. In the present embodiment, the difference values DV1-DV3 are positive integers.

The determining unit 40 receives the difference values DV1-DV3, and determines whether the difference values DV1-DV3 are lower than a threshold value, and outputs a determining result RS to the conversion unit 50. The conversion unit 50 selects a converting algorithm according to the determining result RS to convert the red color value R, the green color value G and the blue color value B into a red color converting value R', a green color converting value G', a blue color converting value B' and a white color converting value W'. Details are described below with reference of a flowchart.

Figures 3, 4:
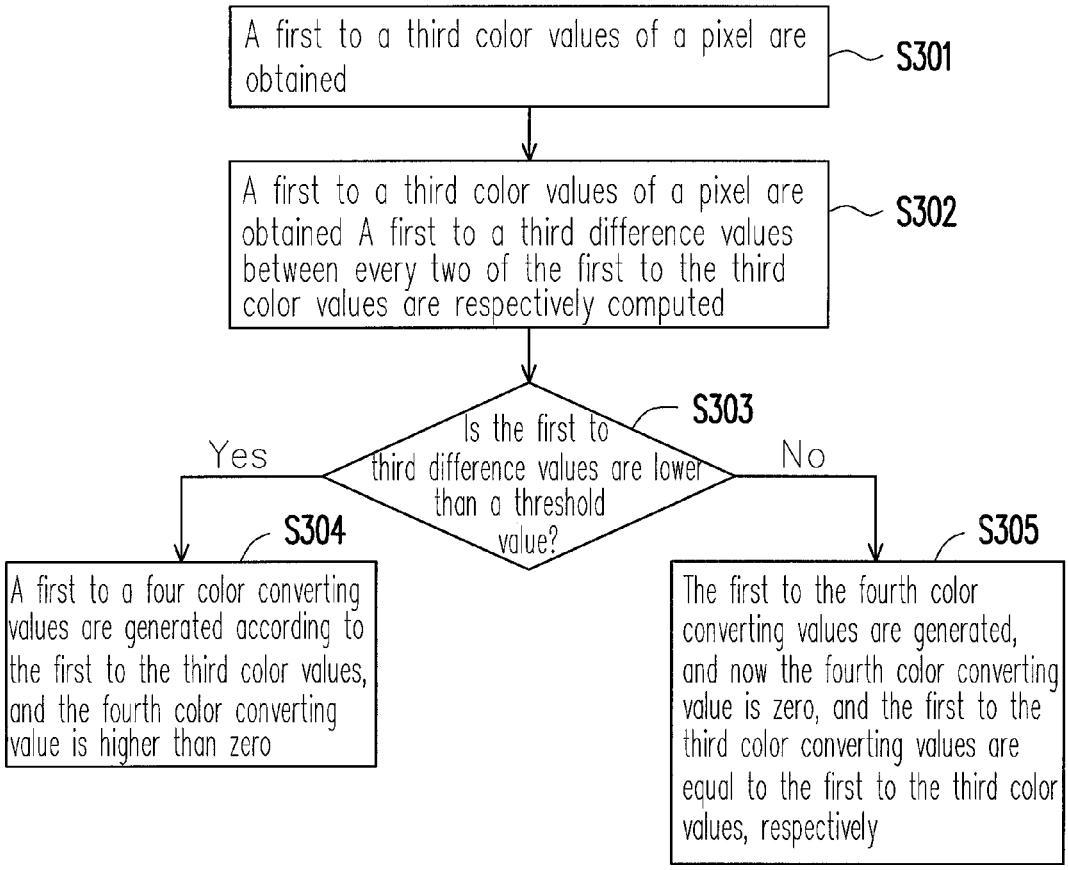
FIG. 3 is a flowchart illustrating a method for converting three color values to four color values according to an embodiment of the present invention.
FIG. 4 is a schematic diagram of a three color image data according to an embodiment of the present invention.
Figures 5, 6:
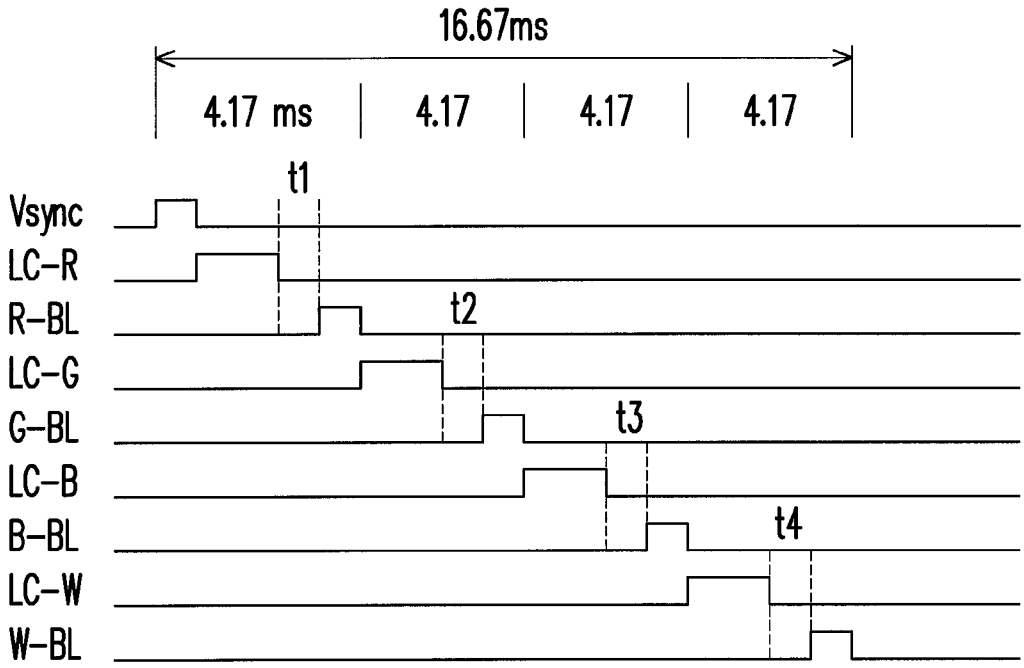
FIG. 5 is a schematic diagram of a four color image data according to an embodiment of the present invention.
FIG. 6 is a timing diagram of control signals of different color liquid crystal units and control signals of different color backlights according to an embodiment of the present invention.

FIG. 3 is a flowchart illustrating a method for converting three color values to four color values according to an embodiment of the present invention. FIG. 4 is a schematic diagram of a three color image data according to an embodiment of the present invention. FIG. 5 is a schematic diagram of a four color, image data according to an embodiment of the present invention. Referring to FIGS. 2-5, in the present embodiment, the three color image data and the four color image data of pixels P1-P9 are taken as an example, though the present invention is not limited thereto, and in the other embodiments, the three color image data and the four color image data can also be images with other resolutions. How to convert the three color values of the pixel P1 into the four color values is first described below.

First, in step S301, the input unit 20 receives the red color value R, the green color value G and the blue color value B of the pixel P1. According to FIG. 4, it is known that the red color value R of the pixel P1 is 10, the green color value G is 15 and the blue color value B is 8.

Next, in step S302, difference values between every two of the red color value R, the green color value G and the blue color value B of the pixel P1 are respectively calculated. In detail, the subtraction unit 31 calculates a difference value between the red color value R and the green color value G to obtain the difference value DV1 of 5. The subtraction unit 32 calculates a difference value between the green color value G and the blue color value B to obtain the difference value DV2 of 7. The subtraction unit 33 calculates a difference value between the blue color value B and the red color value R to obtain the difference value DV3 of 2.

Next, in step S303, it is determined whether the difference values DV1-DV3 are lower than the threshold value. If all of the difference values DV1-DV3 are lower than the threshold value, the conversion unit 50 generates four color converting values according to a step S304. If one of the difference values DV1-DV3 is greater than the threshold value, the conversion unit 50 generates four color converting values according to a step S305. It should be noticed that the step S303 is used for determining whether the color of the corresponding pixel is similar to the White color. If all of the difference values DV1-DV3 are quite small, it represents that the color of the corresponding pixel is similar to the white color, so that if the white color is used to replace the color mixing effect of the red color, the green color and the blue color, color aberration thereof is not obvious. However, if one of the difference values DV1-DV3 is great, it represents that the color of the corresponding pixel is not similar to the white color, so that if the white color is still used to replace the color mixing effect of the red color, the green color and the blue color, it may cause a great color aberration, and the color saturation can be influenced.

In the step S303 of the present embodiment, the determining unit 40 receives the difference values DV1-DV3 output from the subtraction units 31-33, and respectively compares the difference values DV1-DV3 to the threshold value, so as to determine whether the difference values DV1-DV3 are less than the threshold value, and output the determining result RS. Here, the threshold value is, for example, 10, though the present invention is not limited thereto, and those with ordinary skill in the art can determine the threshold value according to an actual requirement. Since the threshold value is 10, and the difference values DV1-DV3 are respectively 5, 7 and 2, the determining result RS indicates that all of the difference values DV1-DV3 are less than the threshold value, so that the step S304 is executed.

In the step S304, the red color converting value R', the green color converting value G', the blue color converting value B' and the white color converting value W' are generated according to the red color value R, the green color value G and the blue color value B of the pixel P1. A method of implementing the step S304 is provided below for those with ordinary skill in the art.

First, the red color value R, the green color value G and the blue color value B are compared to select a minimum one among the red color value R, the green color value G and the blue color value B. Obviously, the blue color value of the pixel P1 is 8, which is the minimum value among the three color values. Next, the white color converting value W' is generated, and a value thereof is equal to the minimum value among the three color values, i.e. the white color converting value W' of the pixel P1 is 8. Next, the red color converting value R' is generated, and a value thereof is equal to the red color value R minus the white color converting value W', i.e. the red color converting value R' of the pixel P1 is 2. Next, the green color converting value G' is generated, and a value thereof is equal to the green color value G minus the white color converting value W', i.e. the green color converting value G' of the pixel P1 is 7. Next, the blue color converting value B' is generated, and a value thereof is equal to the blue color value B minus the white color converting value W', i.e. the blue color converting value B' of the pixel P1 is 0.

On the other hand, in the step S303, if one of the difference values DV1-DV3 is greater than the threshold value, the conversion unit 50 generates four color converting values according to the step S305. Here, the pixel P2 is taken as an example. In the present embodiment, the difference values DV1-DV3 of the pixel P2 are respectively 10, 55 and 45, so that after the step S303, the step S305 is executed. In the step S305, the conversion unit 50 generates the red color converting value R', the green color converting value G', the blue color converting value B' and the white color converting value W', which are respectively equal to the red color value R, the green color value G, the blue color value B and zero. In detail, the red color converting value R', the green color converting value G', the blue color converting value B' and the white color converting value W' of the pixel P2 are respectively 120, 130, 75 and 0.

The steps S301-S305 can be repeated to convert the three color values of the other pixels to the four color values. In the present embodiment, the four color values of the pixels P1, P4, P5, P7 and P8 are converted according to the step S304, by which the CBU phenomenon can be effectively suppressed. It should be noticed that the four color sequential display uses a red backlight source, a green backlight source, a blue backlight source and a white backlight source to display the four color values. Since a light-emitting efficiency of the white backlight source is better than the color mixing effect of the red backlight source, the green backlight source and the blue backlight source, the white color converting value W' is used to replace the color mixing effect of a part of the red color value R, the green color value G and the blue color value B, which can effectively reduce a power consumption of the four color sequential display.

Moreover, in the present embodiment, the four color values of the pixels P2, P3, P6 and P9 are converted according to the step S305, by which the color saturation can be maintained.

It should be noticed that in the present embodiment, setting of the threshold value directly influences effects of suppressing the CBU phenomenon, reducing the power consumption of the display, and maintaining the color saturation, etc. To be specific, the smaller the threshold value is, the better effect for maintaining the color saturation is. Conversely, the greater the threshold value is, the better effects for suppressing the CBU phenomenon and reducing the power consumption of the display are. A timing diagram of control signals of different color liquid crystal units and control signals of different color backlights is provided below for those with ordinary skill in the art.

FIG. 6 is a timing diagram of control signals of different color liquid crystal units and control signals of different color backlights according to an embodiment of the present invention. Referring to FIG. 6, Vsync is a vertical synchronization signal, LC-R is a control signal of a red color liquid crystal unit, R-BL is a control signal of a red color backlight, and t1 is a reaction period of the red color liquid crystal unit. LC-G is a control signal of a green color liquid crystal unit, G-BL is a control signal of a green color backlight, and t2 is a reaction period of the green color liquid crystal unit. LC-B is a control signal of a blue color liquid crystal unit, B-BL is a control signal of a blue color backlight, and t3 is a reaction period of the blue color liquid crystal unit. LC-W is a control signal of a white color liquid crystal unit, W-BL is a control signal of a white color backlight, and t4 is a reaction period of the white color liquid crystal unit.

Though possible patterns of a device and a method for converting three color values to four color values have been described in the aforementioned embodiment, though those with ordinary skill in the art should understand that different manufacturers have different designs for the device and the method for converting three color values to four color values, so that application of the present invention is not limited to the possible patterns. In other words, the spirit of the present invention is met as long as an algorithm for converting the three color values to four color values is selected according to a degree that the color of the pixel being similar to the white color. Embodiments are provided below to those with ordinary skill in the art for a further understanding of the spirit of the present invention.

In the above embodiment, though the threshold value of 10 is taken as an example, the present invention is not limited thereto, and in other embodiments, the threshold value can be 5-15.

In the above embodiment, the method for implementing the step S304 is only an example, and the present invention is not limited thereto. Those with ordinary skill in the art can implement the step S304 according to other methods. Several examples are further provided below with reference of FIG. 4.

In a first example, first, the red color value R, the green color value G and the blue color value B of the pixel P1 are compared to select a minimum one among the red color value R, the green color value G and the blue color value B. Obviously, the blue color value of the pixel P1 is 8, which is the minimum value among the three color values. Next, the white color converting value W' is generated, and a value thereof is equal to an integer of the minimum value times a ratio. In this example, the ratio is, for example, ½, and in other embodiment, the ratio can be other values.

Therefore, the white color converting value W' is 4. Next, the red color converting value R' is generated, and a value thereof is equal to the red color value R minus the white color converting value W', i.e. the red color converting value R' of the pixel P1 is 6. Next, the green color converting value G' is generated, and a value thereof is equal to the green color value G minus the white color converting value W', i.e. the green color converting value G' of the pixel P1 is 11. Next, the blue color converting value B' is generated, and a value thereof is equal to the blue color value B minus the white color converting value W', i.e. the blue color converting value B' of the pixel P1 is 4.

In a second example, X units of the red color value R, Y units of the green color value G and Z units of the blue color value B can be extracted to generate one unit of the white color converting value W', wherein X, Y and Z can be positive values with decimals. In this example, X, Y and Z are, for example, 2, 1 and 2, though the present invention is not limited thereto. Therefore, the red color converting value R', the green color converting value G', the blue color converting value B' and the white color converting value W' of 2, 11, 0 and 4 can be obtained according to the red color value R, the green color value G and the blue color value B of the pixel P1.

It should be noticed that the technique provided by the aforementioned embodiments can be applied to a color sequential liquid crystal display (LCD). The LCD can include a data processing module, a panel module and a backlight module. The data processing module includes the aforementioned device for converting three color values to four color values, which has been described in the aforementioned embodiment, and therefore detailed description thereof is not repeated. The backlight module can be disposed under the panel module, which includes a red backlight source, a green backlight source, a blue backlight source and a white backlight source. The red backlight source is, for example, a light-emitting diode (LED) backlight source capable of independently emitting red light, the green backlight source is, for example, an LED backlight source capable of independently emitting green light, the blue backlight source is, for example, an LED backlight source capable of independently emitting blue light, and the white backlight source is, for example, an LED backlight source capable of independently emitting white light. The red backlight source can suitably generate a red backlight in coordination with an operation of the panel module, the green backlight source can suitably generate a green backlight in coordination with an operation of the panel module, the blue backlight source can suitably generate a blue backlight in coordination with an operation of the panel module, and the white backlight source can suitably generate a white backlight in coordination with an operation of the panel module.

The panel module is coupled to the data processing module, and can display a red sub image of a frame according to the red color converting value. The panel module can display a green sub image of the frame according to the green color converting value. Moreover, the panel module can display a blue sub image of the frame according to the blue color converting value. In addition, the panel module can display a white sub image of the frame according to the white color converting value. By swiftly and alternately displaying the red sub image, the green sub image, the blue sub image and the white sub image by the LCD, the color mixing effect is achieved for human eyes.

Since the white backlight source with a better light-emitting efficiency is used to replace the color mixing effect of the red backlight source, the green backlight source, and the blue backlight source, not only the power consumption is reduced, but also the CBU phenomenon is suppressed.

In the present embodiment, though the backlight module of the LCD is composed of four LED backlight sources capable of independently emitting the red light, the green light the blue light and the white light, the present invention is not limited thereto, and in the other embodiments, the backlight source of the backlight module can also be composed of an LED backlight source capable of emitting the red light, the green light and the blue light, and an LED backlight source capable of emitting the white light. In another embodiment, the backlight source of the backlight module can also be composed of an LED backlight source capable of emitting the red light, the green light, the blue light and the white light.

In summary, in the present invention, a first to a third color values of a pixel are obtained. Further, a first to a third difference values between every two of the first to the third color values are respectively computed. If all of the first to the third difference values are lower than a threshold value, a first to a fourth color converting values are generated according to the first to the third color values, and now the fourth color converting value is greater than zero. On the contrary, the fourth color converting value is zero, and the first to the third color converting values are respectively equal to the first to the third color values. Thereby, not only the color break-up phenomenon can be suppressed, but also the color saturation can be maintained. Moreover, in the embodiments of the present invention, by adjusting the threshold value, effects of suppressing the CBU phenomenon, reducing the power consumption of the display, and maintaining the color saturation, etc. can be changed. The smaller the threshold value is, the better effect for maintaining the color saturation is. Conversely, the greater the threshold value is, the better effects for suppressing the CBU phenomenon and reducing the power consumption of the display are.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for converting three color values to four color values, comprising:

obtaining a first color value, a second color value and a third color value of a pixel;

calculating a first difference value between the first color value and the second color value, a second difference value between the second color value and the third color value and a third difference value between the third color value and the first color value;

generating a first color converting value, a second color converting value, a third color converting value and a fourth color converting value according to the first color value, the second color value and the third color value if the first difference value, the second difference value and the third difference value are lower than a threshold value, and now the fourth color converting value being greater than zero; and generating the first color converting value, the second color converting value, the third color converting value and the fourth color converting value if one of the first difference value, the second difference value and the third difference value is greater than the threshold value, and now the fourth color converting value being zero, and the first color converting value, the second color converting value and the third color converting value being respectively equal to the first color value, the second color value and the third color value.

2. The method for converting three color values to four color values as claimed in claim 1, wherein the step of generating the first color converting value, the second color converting value, the third color converting value and the fourth color converting value according to the first color value, the second color value and the third color value if the first difference value, the second difference value and the third difference value are lower than the threshold value comprises:

generating the fourth color converting value, and now the fourth color converting value being equal to a minimum one of the first color value, the second color value and the third color value;

generating the first color converting value, and now the first color converting value being equal to the first color value minus the fourth color converting value;

generating the second color converting value, and now the second color converting value being equal to the second color value minus the fourth color converting value; and generating the third color converting value, and now the third color converting value being equal to the third color value minus the fourth color converting value.

3. The method for converting three color values to four color values as claimed in claim 1, wherein the first color value, the second color value and the third color value are respectively a red color value, a green color value and a blue color value, and the first color converting value, the second color converting value, the third color converting value and the fourth color converting value are respectively the red color value, the green color value, the blue color value and a white color value.

4. The method for converting three color values to four color values as claimed in claim 1, wherein the first difference value, the second difference value and the third difference value are positive integers.

5. A device for converting three color values to four color values, comprising:

an input unit, obtaining a first color value, a second color value and a third color value of a pixel;

a first subtraction unit, coupled to the input unit and calculating a first difference value between the first color value and the second color value;

a second subtraction unit, coupled to the input unit and calculating a second difference value between the second color value and the third color value;

a third subtraction unit, coupled to the input unit and calculating a third difference value between the third color value and the first color value;

a determining unit, coupled to the first subtraction unit, the second subtraction unit and the third subtraction unit, and determining whether the first difference value, the second difference value and the third difference value are lower than a threshold value, so as to generate a determining result; and a conversion unit, coupled to the input unit and the determining unit, wherein if the determining result is affirmative, the conversion unit generates a first color converting value, a second color converting value, a third color converting value and a fourth color converting value according to the first color value, the second color value and the third color value, and now the fourth color converting value is greater than zero, if the determining result is negative, the conversion unit generates the first color converting value, the second color converting value, the third color converting value and the fourth color converting value, and now the fourth color converting value is zero, and the first color converting value, the second color converting value and the third color converting value are respectively equal to the first color value, the second color value and the third color value.

6. The device for converting three color values to four color values as claimed in claim 5, wherein if the determining result is affirmative, the conversion unit generates the first color converting value, the second color converting value, the third color converting value and the fourth color converting value according to the first color value, the second color value and the third color value, and now the fourth color converting value is equal to a minimum one of the first color value, the second color value and the third color value, the first color converting value is equal to the first color value minus the fourth color converting value, the second color converting value is equal to the second color value minus the fourth color converting value, and the third color converting value is equal to the third color value minus the fourth color converting value.

7. The device for converting three color values to four color values as claimed in claim 5, wherein the first color value, the second color value and the third color value are respectively a red color value, a green color value and a blue color value, and the first color converting value, the second color converting value, the third color converting value and the fourth color converting value are respectively the red color value, the green color value, the blue color value and a white color value.

8. The device for converting three color values to four color values as claimed in claim 5, wherein the first difference value, the second difference value and the third difference value are positive integers.

9. A driving method for a liquid crystal display (LCD), the LCD comprising a panel module and a backlight module, the backlight module comprising a red backlight source, a green backlight source, a blue backlight source and a white backlight source, the driving method comprising:

obtaining a red color value, a green color value and a blue color value of a pixel;

calculating a first difference value between the red color value and the green color value, a second difference value between the green color value and the blue color value, and a third difference value between the blue color value and the red color value;

generating a red color converting value, a green color converting value, a blue color converting value and a white color converting value according to the red color value, the green color value and the blue color value if the first difference value, the second difference value and the third difference value are lower than a threshold value, and now the white color converting value being greater than zero;

generating the red color converting value, the green color converting value, the blue color converting value and the white color converting value if one of the first difference value, the second difference value and the third difference value is greater than the threshold value, and now the white color converting value being zero, and the red color converting value, the green color converting value and the blue color converting value being respectively equal to the red color value, the green color value and the blue color value;

displaying a red sub image of a frame by the panel module according to the red color converting value and a red backlight sent from the red backlight source;

displaying a green sub image of the frame by the panel module according to the green color converting value and a green backlight sent from the green backlight source;

displaying a blue sub image of the frame by the panel module according to the blue color converting value and a blue backlight sent from the blue backlight source; and displaying a white sub image of the frame by the panel module according to the white color converting value and a white backlight sent from the white backlight source.

10. The driving method for the LCD as claimed in claim 9, wherein the step of generating the red color converting value, the green color converting value, the blue color converting value and the white color converting value according to the red color value, the green color value and the blue color value if the first difference value, the second difference value and the third difference value are lower than a threshold value comprises:

generating the white color converting value, and now the white color converting value being equal to a minimum one of the red color value, the green color value and the blue color value;

generating the red color converting value, and now the red color converting value being equal to the red color value minus the white color converting value;

generating the green color converting value, and now the green color converting value being equal to the green color value minus the white color converting value; and generating the blue color converting value, and now the blue color converting value being equal to the blue color value minus the white color converting value.

11. The driving method for the LCD as claimed in claim 9, wherein the first difference value, the second difference value and the third difference value are positive integers.

12. An LCD, comprising:

a data processing module, comprising:

an input unit, obtaining a red color value, a green color value and a blue color value of a pixel;

a first subtraction unit, coupled to the input unit and calculating a first difference value between the red color value and the green color value;

a second subtraction unit, coupled to the input unit and calculating a second difference value between the green color value and the blue color value;

a third subtraction unit, coupled to the input unit and calculating a third difference value between the blue color value and the red color value;

a determining unit, coupled to the first subtraction unit, the second subtraction unit and the third subtraction unit for determining whether the first difference value, the second difference value and the third difference value are lower than a threshold value, so as to generate a determining result; and a conversion unit, coupled to the input unit and the determining unit, wherein if the determining result is affirmative, the conversion unit generates a red color converting value, a green color converting value, a blue color converting value and a white color converting value according to the red color value, the green color value and the blue color value, and now the white color converting value is greater than zero, if the determining result is negative, the conversion unit generates the red color converting value, the green color converting value, the blue color converting value and the white color converting value, and now the white color converting value is zero, and the red color converting value, the green color converting value and the blue color converting value are respectively equal to the red color value, the green color value and the blue color value;

a panel module, coupled to the data processing module, displaying a red sub image of a frame according to the red color converting value, displaying a green sub image of the frame according to the green color converting value, displaying a blue sub image of the frame according to the blue color converting value, and displaying a white sub image of the frame according to the white color converting value; and a backlight module, disposed under the panel module and suitably generating a red backlight, a green backlight, a blue backlight and a white backlight according to operations of the panel module, so that the panel module displays the red sub image, the green sub image, the blue sub image and the white sub image.

13. The LCD as claimed in claim 12, wherein if the determining result is affirmative, the conversion unit generates the red color converting value, the green color converting value, the blue color converting value and the white color converting value according to the red color value, the green color value and the blue color value, and now the white color converting value is equal to a minimum one of the red color value, the green color value and the blue color value, the red color converting value is equal to the red color value minus the white color converting value, the green color converting value is equal to the green color value minus the white color converting value, and the blue color converting value is equal to the blue color value minus the white color converting value.

14. The LCD as claimed in claim 12, wherein the first difference value, the second difference value and the third difference value are positive integers.

15. The LCD as claimed in claim 12, wherein the backlight module comprises:

a red backlight source, suitably generating a red backlight according to an operation of the panel module, so that the panel module displays the red sub image;

a green backlight source, suitably generating a green backlight according to an operation of the panel module, so that the panel module displays the green sub image;

a blue backlight source, suitably generating a blue backlight according to an operation of the panel module, so that the panel module displays the blue sub image; and a white backlight source, suitably generating a white backlight according to an operation of the panel module, so that the panel module displays the white sub image.

16. The LCD as claimed in claim 15, wherein the red backlight source is a light-emitting diode (LED) backlight source capable of independently emitting red light, the green backlight source is an LED backlight source capable of independently emitting green light, the blue backlight source is an LED backlight source capable of independently emitting blue light, and the white backlight source is an LED backlight source capable of independently emitting white light.

17. The LCD as claimed in claim 12, wherein the backlight module comprises:

a red green blue backlight source, suitably generating the red backlight, the green backlight and the blue backlight according to operations of the panel module, so that the panel module displays the red sub image, the green sub image and the blue sub image; and a white backlight source, suitably generating the white backlight according to an operation of the panel module, so that the panel module displays the white sub image.

18. The LCD as claimed in claim 17, wherein the red green blue backlight source is an LED backlight source capable of emitting red light, green light and blue light, and the white backlight source is an LED backlight source capable of independently emitting white light.

19. The LCD as claimed in claim 12, wherein the backlight module comprises:

a red green blue white backlight source, suitably generating the red backlight, the green backlight, the blue backlight and the white backlight according to operations of the panel module, so that the panel module displays the red sub image, the green sub image, the blue sub image and the white sub image.

20. The LCD as claimed in claim 19, wherein the red green blue white backlight source is an LED backlight source capable of emitting red light, green light, blue light and white light.

* * * * *